US008220639B2

(12) United States Patent
Hoffman et al.

(10) Patent No.: US 8,220,639 B2
(45) Date of Patent: Jul. 17, 2012

(54) SORTING APPARATUS AND METHOD UTILIZING A MECHANICAL DIVERTER

(75) Inventors: Philip L. Hoffman, Walla Walla, WA (US); Hans G. Haimberger, Milton-Freewater, OR (US); Ken McGarvey, Walla Walla, WA (US); James Ruff, Walla Walla, WA (US); Mike Lemke, Touchet, WA (US); Timothy Reardon, Walla Walla, WA (US)

(73) Assignee: Key Technology, Inc., Walla Walla, WA (US)

( * ) Notice: Subject to any disclaimer, the term of this patent is extended or adjusted under 35 U.S.C. 154(b) by 348 days.

(21) Appl. No.: 12/383,199

(22) Filed: Mar. 19, 2009

(65) Prior Publication Data

US 2010/0236994 A1 Sep. 23, 2010

(51) Int. Cl.
*B07C 5/00* (2006.01)
*B07C 1/00* (2006.01)

(52) U.S. Cl. ..... 209/651; 209/44.2; 209/552; 209/571; 209/576

(58) Field of Classification Search ..... 209/44.2, 209/552, 571, 576, 644, 651, 652, 655, 657
See application file for complete search history.

(56) References Cited

U.S. PATENT DOCUMENTS

| | | | | | |
|---|---|---|---|---|---|
| 3,872,306 | A | | 3/1975 | Palmer | |
| 4,081,362 | A | | 3/1978 | Chamberlin et al. | |
| 4,314,645 | A | | 2/1982 | Perkins, III et al. | |
| 4,324,336 | A | | 4/1982 | Sandbank | |
| 4,348,277 | A | * | 9/1982 | Cowlin et al. | 209/705 |
| 5,042,637 | A | * | 8/1991 | LaVars et al. | 198/370.02 |
| 5,197,607 | A | | 3/1993 | Hakansson | |
| 5,509,537 | A | | 4/1996 | Crismon et al. | |
| 5,887,073 | A | * | 3/1999 | Fazzari et al. | 382/110 |
| 5,979,667 | A | * | 11/1999 | Earl | 209/657 |
| 6,727,452 | B2 | | 4/2004 | Schrader | |
| 2010/0236994 | A1 | * | 9/2010 | Hoffman et al. | 209/44.2 |

OTHER PUBLICATIONS

PCT/ISA/220, Jul. 29, 2010, PCT Search Report and Written Opinion.

http://www.magnusoncorp.biz/ccm.html "Automatic Corn Cutter" 6 pages of website, printed Jun. 18, 2010.

* cited by examiner

*Primary Examiner* — Terrell Matthews
(74) *Attorney, Agent, or Firm* — Paine Hamblen, LLP

(57) ABSTRACT

The present invention is an apparatus and method for sorting foreign material and undesirable articles from a product stream. A mechanical diverter having a concave shape is responsive to an inspection station coupled to the product stream. The mechanical diverter is employed to effectively launch or otherwise redirect undesirable articles in an alternate path. In addition, an air ejector is responsive to the inspection station and is employed to dislodge foreign material from the product stream.

6 Claims, 7 Drawing Sheets

SORTING APPARATUS AND METHOD UTILIZING A MECHANICAL DIVERTER

TECHNICAL FIELD

The present invention relates to a sorting apparatus and method and more specifically to a sorting apparatus and method for separating articles in a product stream using a mechanical diverter responsive to a machine vision system. The present invention also includes a combination of a sorting apparatus that uses an air ejector for foreign material removal and a mechanical diverter for redirecting undesirable articles from a product stream.

BACKGROUND OF THE INVENTION

Sorting Methods and machines have been known and practiced for many years in the production of goods including comestible articles. The machines found in the art include types that utilize reflecting electromagnetic radiation in the form of light to determine the optical reflective characteristics of the articles in the product stream using color as a determinant followed by an ejector to successfully remove offending articles. A notable example of such a sorter is the High Speed Mass Flow Sorting Apparatus for Optically Inspection and Sorting Bulk Food Products as shown in U.S. Pat. No. 5,887,073 assigned to Key Technology, Inc.

Successful removal of offending or undesirable articles has been practiced to varying degrees of efficiency using several different approaches including air ejection and mechanical diversion. Experience has shown that air ejection techniques are suitable for a wide range of article types, but is best applied for smaller, less dense articles that can be easily influenced by a jet of fluid. Examples of articles suitable for air ejection include peas, corn, potato strips, potato crisps, and foreign material. Air ejection as commonly practiced utilizes a plurality of electrically controlled valves that are individually controlled by a machine vision system, and targeted toward offending articles in a product stream. Thus, the offending articles are dislodged from their course of travel and caused to take an alternate path, removing them from the product stream.

Alternatively, mechanical diversion is similarly suitable for a wide range of articles, however, it is best applied for larger articles that are less susceptible to influence by a jet of fluid. Examples of articles suitable for mechanical diversion include oranges, grape fruit, onions, and potatoes. Mechanical diverters are known in the art to require more frequent maintenance than air ejectors. In addition, mechanical diverters are more prone to bruise undesirable articles during diversion.

An example of a sorter using a mechanical diversion technique is found in U.S. Pat. No. 5,979,667 where a rigid paddle is taught that selectively strikes articles from the product stream forcing them onto another path. In this reference, a pulsed light sensor interrogates a product stream of articles such as tomatoes. A color comparator utilizes information from the pulsed light sensor to identify undesirable articles. A pneumatically operated and electrically controlled rigid paddle is positioned so that undesirable articles are expelled from the product stream by striking them during their path to send them to an alternate location. The reference also teaches the option of reversing the logic so that the rigid paddle is used to divert acceptable articles. Unfortunately, the striking action of the rigid paddle upon the article during its course of travel has the potential to bruise the articles, reducing their value.

Another example is found in U.S. Pat. No. 5,509,537 where a flexible finger is used to selectively strike undesirable articles from the product stream. Here, the flexible finger is presented as an alternative to the rigid paddle described above, citing an improvement in maintenance over the prior art. One might expect that the striking flexible finger might decrease adverse impact to the article. However, such a flexible finger would decrease the accuracy of the ejection operation by nature of its flexibility.

The present invention overcomes this and other limitation of the prior art. For instance, none of these examples, or other examples in the art teach a sorter that utilizes a mechanical diverter having a concave shape that can gently redirect undesirable articles to another path for further, processing. In addition, the art does not teach the combination of utilizing both air ejection and mechanical diversion in a single sorter.

SUMMARY OF THE INVENTION

One aspect of the invention is a sorting apparatus for separating articles in a product stream, including an endless belt conveyor configured to launch articles from the product stream in a first trajectory, an inspection station coupled to the product stream and operable to provide a routing signal based on inspection of the product stream, and a diverter comprising a launching block having a concave surface, and located in downstream relation to the inspection station, and controlled by the routing signal, and wherein the diverter has a retracted position where articles extend their travel in the first trajectory, and an extended position where articles interact with the diverter in a gliding manner along the concave surface to effectively launch the articles into a second trajectory.

Another aspect of the invention is a sorting apparatus for separating articles in a product stream, including a conveying means to transport and launch the articles in a product stream in a first trajectory, an inspection means coupled to the product stream to provide a first and second routing signal based on inspection of the product stream, and a diverter means having a concave member, and controlled by the first and second routing signals and located in downstream relation to the inspection station to pass articles in the first trajectory in response to the first routing signal, and to urge articles to assume a second trajectory in response to the second routing signal by urging the articles to glide along the diverter so that the articles are effectively launched into a second trajectory.

Yet another aspect of the invention is a sorting apparatus for separating articles in a product stream having acceptable articles, unacceptable articles, and foreign material, including an endless belt conveyor configured to launch the product stream in a first trajectory, an inspection station coupled to the product stream and operable to provide a plurality of routing signals based on inspection of the product stream, a first air ejection station located in downstream relation to the inspection station, and controlled by a first portion of the plurality of routing signals, and configured to expel the foreign material from the product stream product stream in a second trajectory, and a concave shaped diverter located in downstream relation to the inspection station that is controlled by a second portion of the plurality of routing signals, and operable to launch undesirable articles from the product stream so that they become separated from the desirable articles in the product stream.

And yet another aspect of the invention is a method of separating articles from a product stream into a plurality of routes, including conveying the product stream, launching the product stream in a first trajectory, inspecting the product stream, providing a first and second routing signal based on inspection of the product stream, providing a diverter having a concave surface that is responsive to the first and second routing signals so that the diverter is configured in a retracted position in response to the first routing signal, and configured in an extended position in response to the second routing signal, passing articles from the product stream so that they continue to travel in the first trajectory when the diverter is configured in the retracted position, and launching articles from the product stream by urging the articles to glide along a portion of a surface of the diverter so that they assume a second trajectory when the diverter is configured in the extended position.

These and other aspects of the present invention will be described in greater detail hereinafter.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
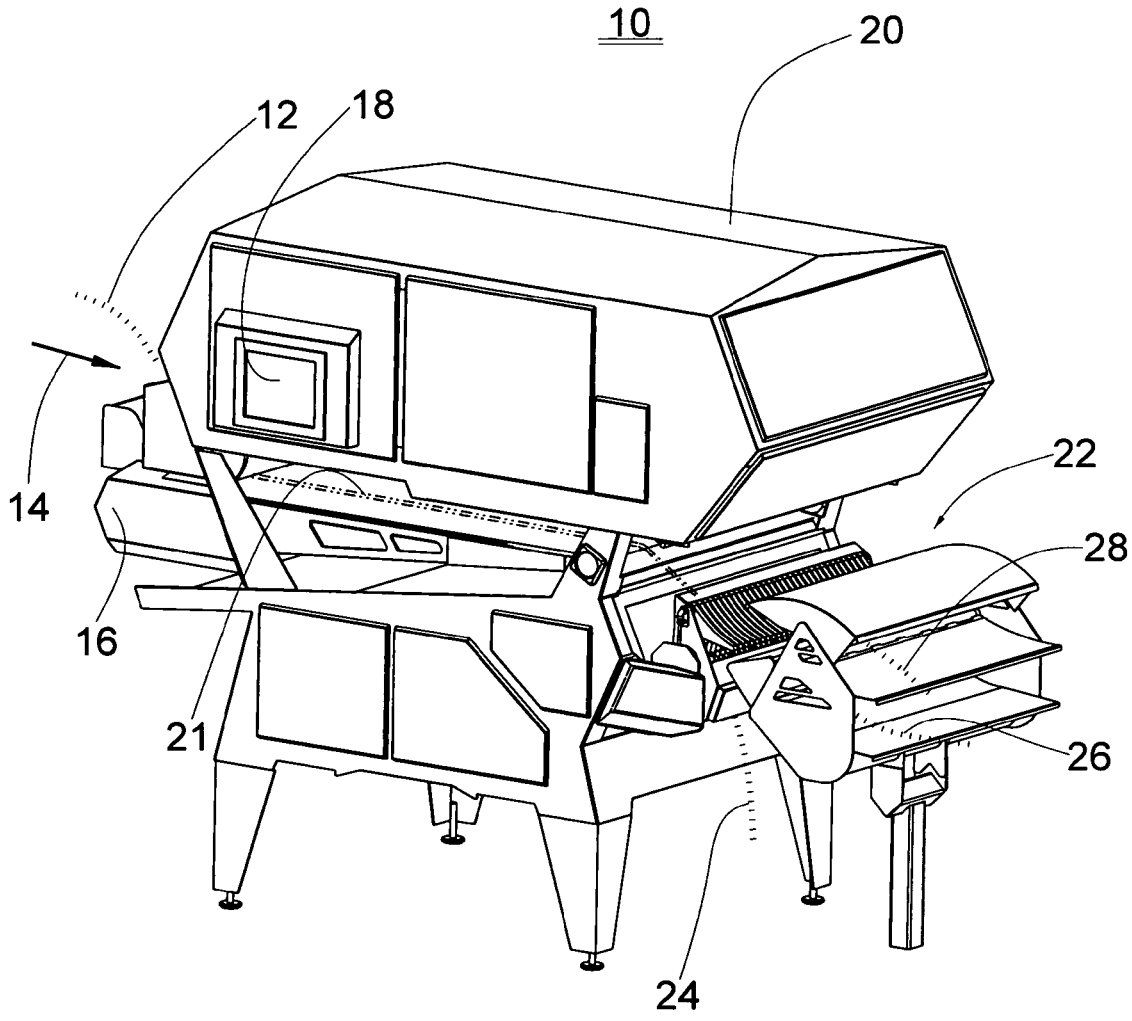
FIG. 1 is an isometric diagram of a preferred embodiment of the sorting apparatus.

Referring now to FIG. 1, an apparatus for sorting articles utilizing a mechanical diverter is shown and is generally identified by the numeral 10 and will be referred to as a sorter in this disclosure. The sorter 10 is installed in a processing line adjacent to other equipment in a continuous production system. The apparatus 10 is located in a processing line in a strategic location where the quality of each article is ascertained and is routed for further processing.

A stream of articles or incoming product stream 12 is introduced at an infeed end of the sorter 10. In practice, the product stream 12 may be composed of any article of manufacture or production, and often includes both desirable articles which meet the specification of quality and undesirable articles which fall outside the specification of quality. Further, the incoming product stream 12 may contain other materials which have a different nature than the articles and will herein be referred to as foreign material. The product stream 12 is composed of individual articles traveling in a direction generally depicted by the flow arrow 14. The product stream 12 may include individual articles that are moving in concert at a generally uniform speed and traveling in the product flow direction 14.

Articles in the product stream 12 are introduced to an endless belt conveyor 16 that is integrated into the sorter 10 for transporting the articles through the sorter 10. The conveyor 16 includes an endless belt selected to provide a sufficient force of friction for stabilizing articles in the product stream 12 as they are transported in the flow direction 14.

The sorter 10 includes a user interface 18 that enables an operator (not shown) to observe and control various operational aspects of the sorter 10. From the user interface 18, an operator can view representations of the articles in the product stream 12 as they are processed in the sorter 10. In addition, the user interface 18 provides a means for the operator to configure the operation of the sorter 10 to enable the sorter to make a determination between acceptable articles, undesirable articles, and foreign material.

Articles in the product stream 12 are transported along a path to the end of the conveyor 16 where they are launched in a trajectory. The product stream 12 is composed of articles that are scattered across both a width and length of the conveyor 16, and are illustrated in a single-file manner in FIG. 2. During this transport, articles and foreign material in the product stream 12 are interrogated by an inspection station 20 across the width of the sorter 10. The inspection station 20 includes sensors that provide signals representative of physical parameters of articles and foreign material in the product stream 12 and a processor that uses these signals in combination with information provided by an operator to make a determination of the projected routing of the articles and foreign material in the process line. The inspection station 20 is operable to process a plurality of articles as they travel through the sorter 10, scanning the articles, and grouping them into objects. These objects are further ordered into virtual lanes, one of which is pointed to by the numeral 21. Each virtual lane 21 is composed of objects following one-another in time oriented relation.

A routing assembly 22 is positioned in downstream relation to the inspection station 20 and is configured to respond to directives provided by the inspection station 20. The routing assembly 22 includes a plurality of active diverters that are capable to urge articles and foreign material in the product stream 12 to follow predefined paths. One such path is a foreign material path 24 which is established as a path for foreign material in the product stream 12 to follow. A second path is an acceptable article path 26 provided for acceptable articles in the product stream 12 to follow. Another such path is an unacceptable article path 28 maintained for unacceptable articles in the product stream 12.

Figure 2:
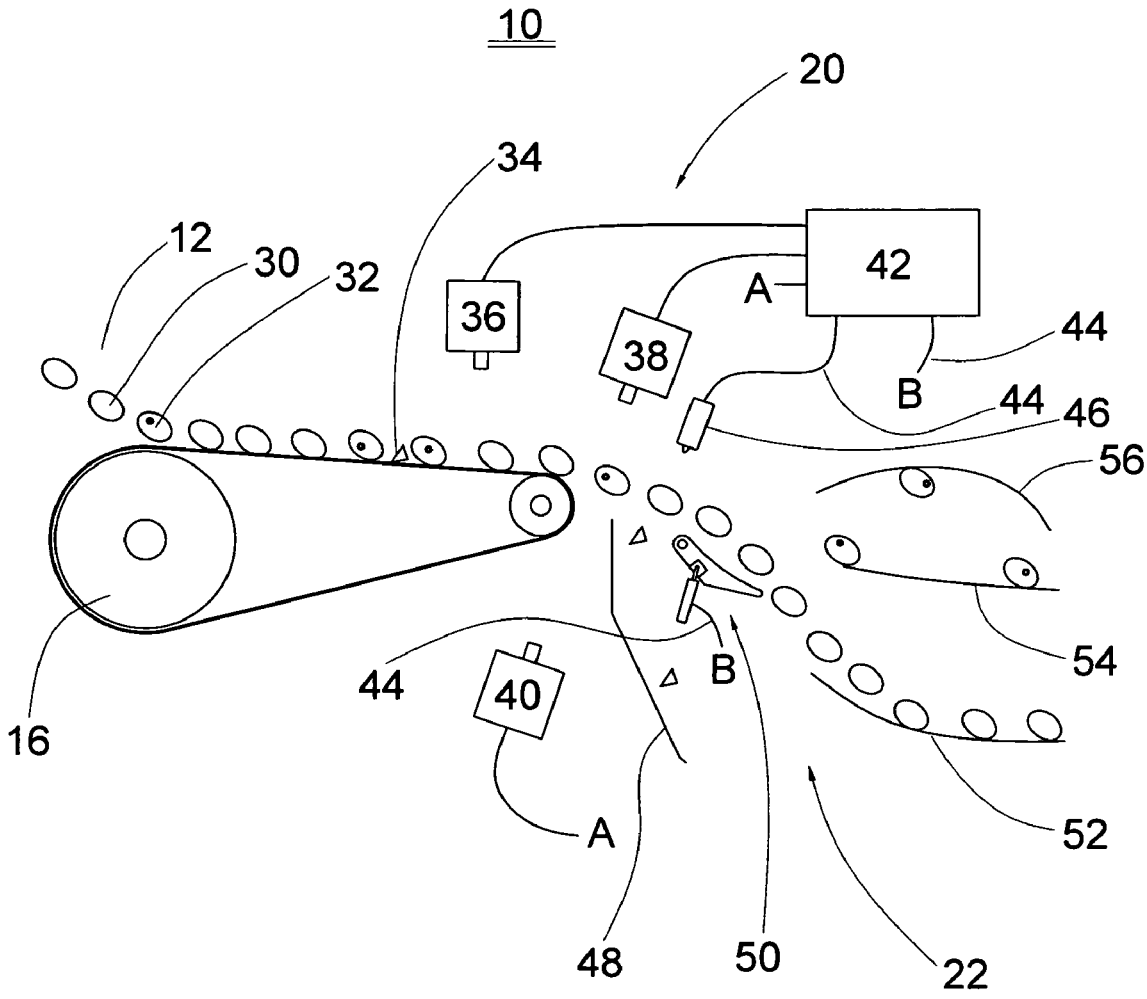
FIG. 2 is a block schematic diagram of the sorting apparatus detailing the flow of articles from the product stream through the apparatus.
Figure 5:
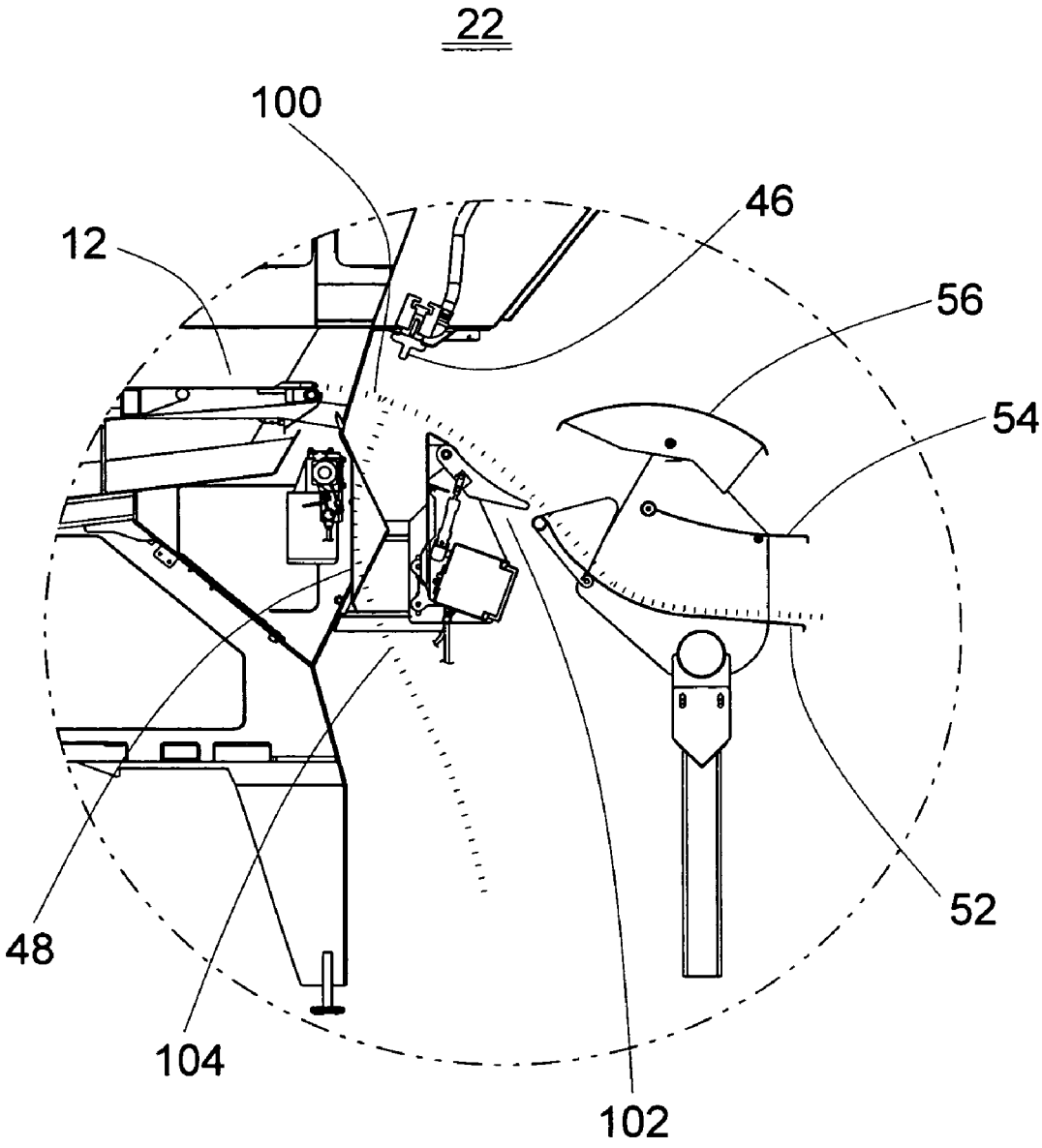
FIG. 5 is an elevation view of a separation assembly of the sorting apparatus showing a trace of a foreign material trajectory and another trace of a normal trajectory.
Figure 6:
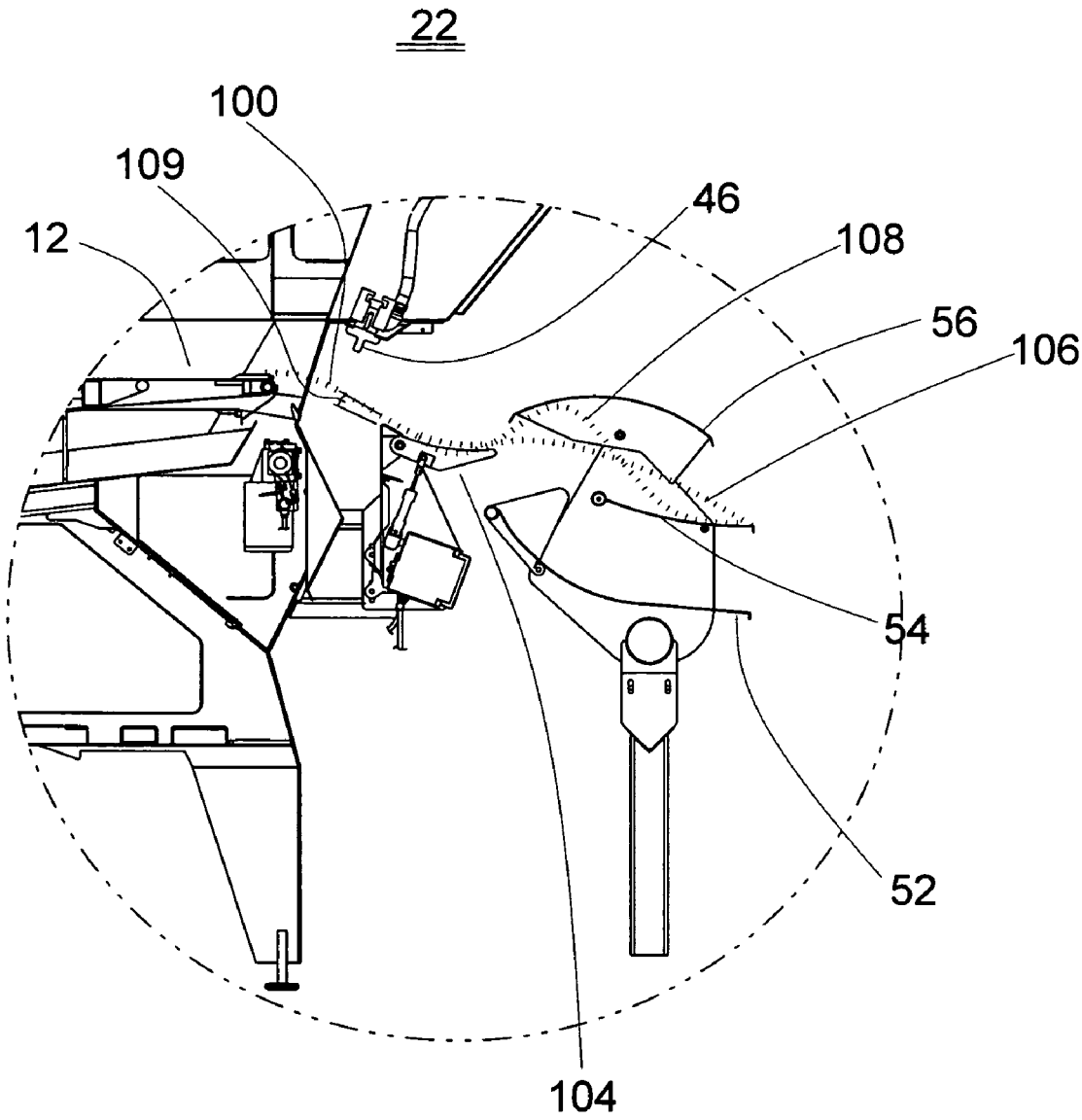
FIG. 6 is an elevation view of a separation assembly of the sorting apparatus showing a trace of a gentle trajectory and a trace of an aggressive trajectory.

Now referring to FIGS. 2, 5 and 6 the product stream 12 is illustrated as a composition of acceptable articles generally designated by the numeral 30, unacceptable articles generally designated by the numeral 32, and foreign material generally designated by the numeral 34. The product stream 12 is transported by the endless belt conveyor 16 and is launched as it passes through the inspection station 20 and the routing assembly 22 in an initial or normal trajectory 100. From inspection of FIG. 2, the product stream 12 is represented as a single virtual lane 21 (FIG. 1) of articles, although in a preferred embodiment, the sorter 10 includes a plurality of virtual lanes 21 arranged across the width of the sorter 10.

The inspection station 20 includes a first camera 36 positioned to view the product stream 12 as it is transported by the endless belt conveyor 16. A second camera 38 is positioned to provide a downward looking view of the product stream 12 after it has been launched by the endless belt conveyor 16. A third camera 40 is positioned to provide an upward looking view of the product stream 12 and after it has been launched by the endless belt conveyor 16. It should be understood that the inspection station 20 may include fewer or a greater number of cameras or other types of sensors including photodiodes, photomultiplier tubes, or other types of imaging devices known in the art without departing from the scope of this invention.

The inspection station 20 also includes a sorting processor 42 that is connected to each of the cameras 36, 38, and 40 and is operable to process signals provided by each of the cameras to provide data indicative of physical characteristics of articles and foreign material in the product stream 12. The sorting processor 42 compares these signals with guidance provided by an operator (via the user interface 18 (FIG. 1)) to provide a plurality of routing signals 44 to command actuators in the routing assembly 22 whose composition and detail will be discussed in further detail below.

The routing assembly 22 includes an ejector 46 positioned above and directed toward the product stream 12 and is connected to one of the routing signals 44. The ejector 42 is composed of a plurality of solenoid valves and jets arranged across the width of the sorter 10 that operate to direct a pulse of air toward the product stream 12 to dislodge from the product stream 12 an article or foreign material targeted by the sorting processor in response to the routing signal 44. Each of the plurality of jets in the ejector 42 is associated with one virtual lane 21 (FIG. 1) as discussed above. In a preferred embodiment of the sorter 10, foreign material 34 pieces are targeted and extracted from the product stream to travel in a downward manner toward an ejector chute 48, traveling in a path approximately following the foreign material trajectory 104.

The routing assembly 22 also includes a mechanical diverter assembly 50 that is operably connected to the routing signals 44 composed of commands provided by the sorting processor 42. The diverter assembly 50 is positioned beneath the product stream 12 and in a manner so that it can interact with the product stream 12 to efficiently route articles in the product stream 12 to a lower slide 52 and an upper slide 54. An upper guide 56 is provided and positioned above the upper slide 54 whose operation will be discussed in further detail below.

In a preferred embodiment, acceptable articles 30 are routed through the region defined between the lower slide 52 and the upper slide 54 and follow the normal trajectory 100 until encountering the lower slide 52. Also in a preferred embodiment, unacceptable articles 32 are routed through the region defined between the upper slide 54 and the upper guide 56 and follow either a gentle trajectory 106 or an aggressive trajectory 108. The diverter assembly 50 is shown in a retracted position 102 in FIG. 5 and in an extended position 104 in FIG. 6.

Figure 3:
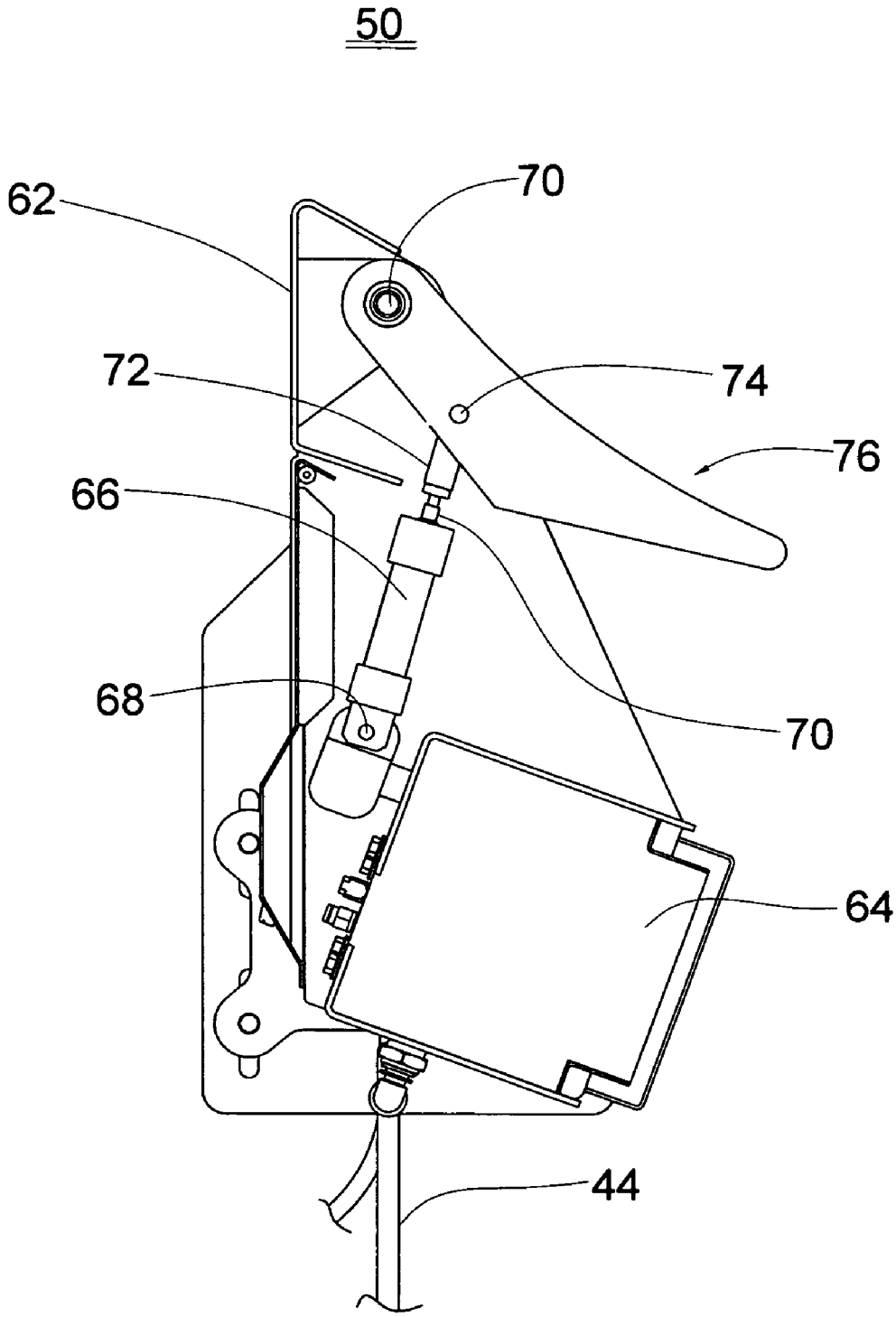
FIG. 3 is an elevation view of a single diverter that is employed in the sorting apparatus.

Now referring to FIG. 3 the diverter assembly 50 includes a mounting frame 62 which is fastened to the sorter 10, extending in transverse relation underneath the product stream 12. A valve assembly 64 is borne by the mounting frame 62 and is connected to some of the routing signals 44. The valve assembly 64 includes a manifold for transfer of an air supply and a plurality of solenoid valves juxtaposed and connected to the plurality of routing signals 44.

A plurality of actuators 66 are connected in fluid transmission relation to the plurality of solenoid valves in the valve assembly 64 and are each borne by the mounting frame 62 on a plurality of actuator pivot pins 68. Each actuator has a rod 70 operable to positionally respond to fluid pressure. A bracket 72 is fastened to each rod 70.

A plurality of launching blocks 76 are pivotally positioned in juxtaposed relation between a plurality of pivot pins 70 that are located on the mounting frame 62, and between the bracket 72. A block pin 74 retains the launching block 76 to the bracket 72. Each launching block 76 is fastened in such a manner that an extension of the rod 70 of the actuator 66 effectively raises a portion of the launching block 76 enabling a controllable interaction with the product stream 12 which is effective in routing articles in response to commands from the sorting processor 42 (FIG. 2). Each of the plurality of launching blocks 76 is associated, with a virtual lane 21 (FIG. 1) of the sorter 10.

In a preferred embodiment, the actuator 66 is a pneumatic cylinder having sufficient piston area to accurately position the launching block 76 in response to commands from the sorting processor 42.

Figure 4A:
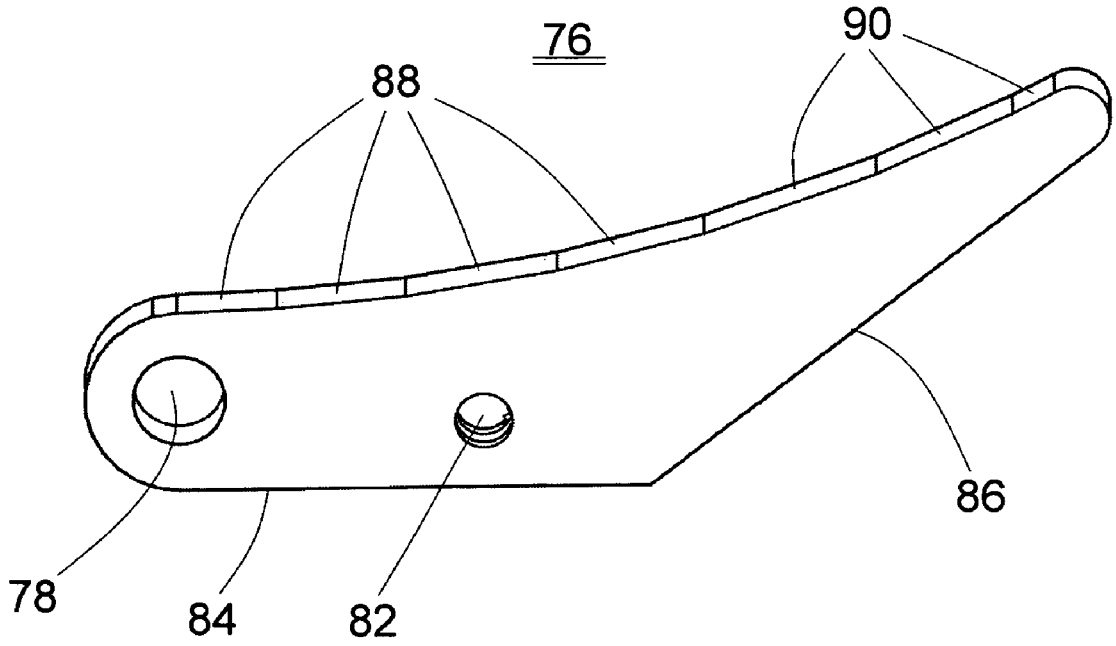
FIG. 4*a* is a perspective view of a launching block from the diverter.
Figure 4B:
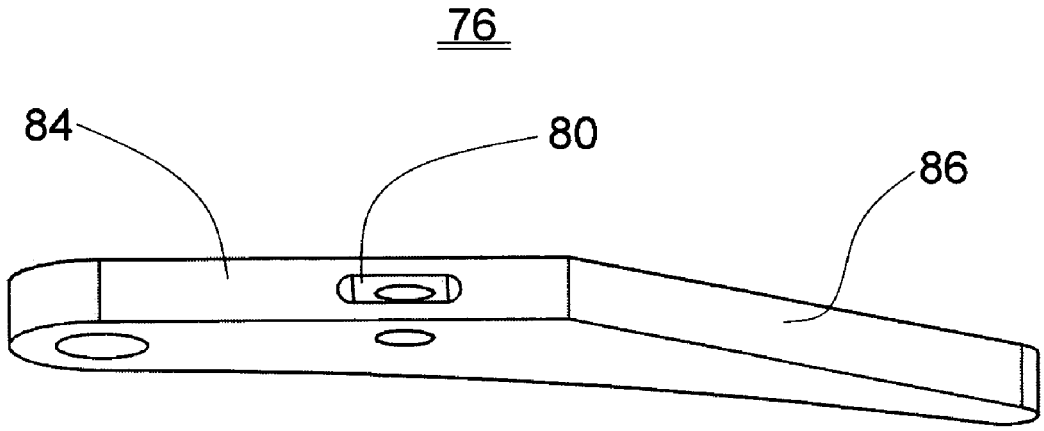
FIG. 4*b* is an inverted perspective view of a launching block from the diverter.

Now referring to FIGS. 4*a* and 4*b*, the launching block 76 is fabricated using an industrial plastic and has a pivot aperture 78 formed therein and fashioned to accept the pivot pin 70 (FIG. 3). A notch 80 and a bracket pin aperture 82 are each formed in the launching block 76. The combination of the notch 80 and the aperture 82 form a clevis fabricated to accept the bracket 72 (FIG. 3) and the block pin 74. The launching block 76 has a base surface 84 extending to a front surface 86 that extends in an obtuse fashion. Opposite the base surface 84 is a contact surface 88 having a concave shape. Adjacent to this surface is a launching surface 90 also having a concave shape.

Now referring to FIGS. 4*a* and 6, the launching block 76 is fashioned so that, when the diverter assembly 50 is configured in the extended position 104, that a nominal angle 109 exists between the normal trajectory 100 and the contact surface 88 of the launching block 76. Minimizing this nominal angle 109 is helpful to reduce bruising of the articles as they contact the launching block 76. In a preferred embodiment, the nominal angle 109 is less than 20 degrees.

Figure 7:
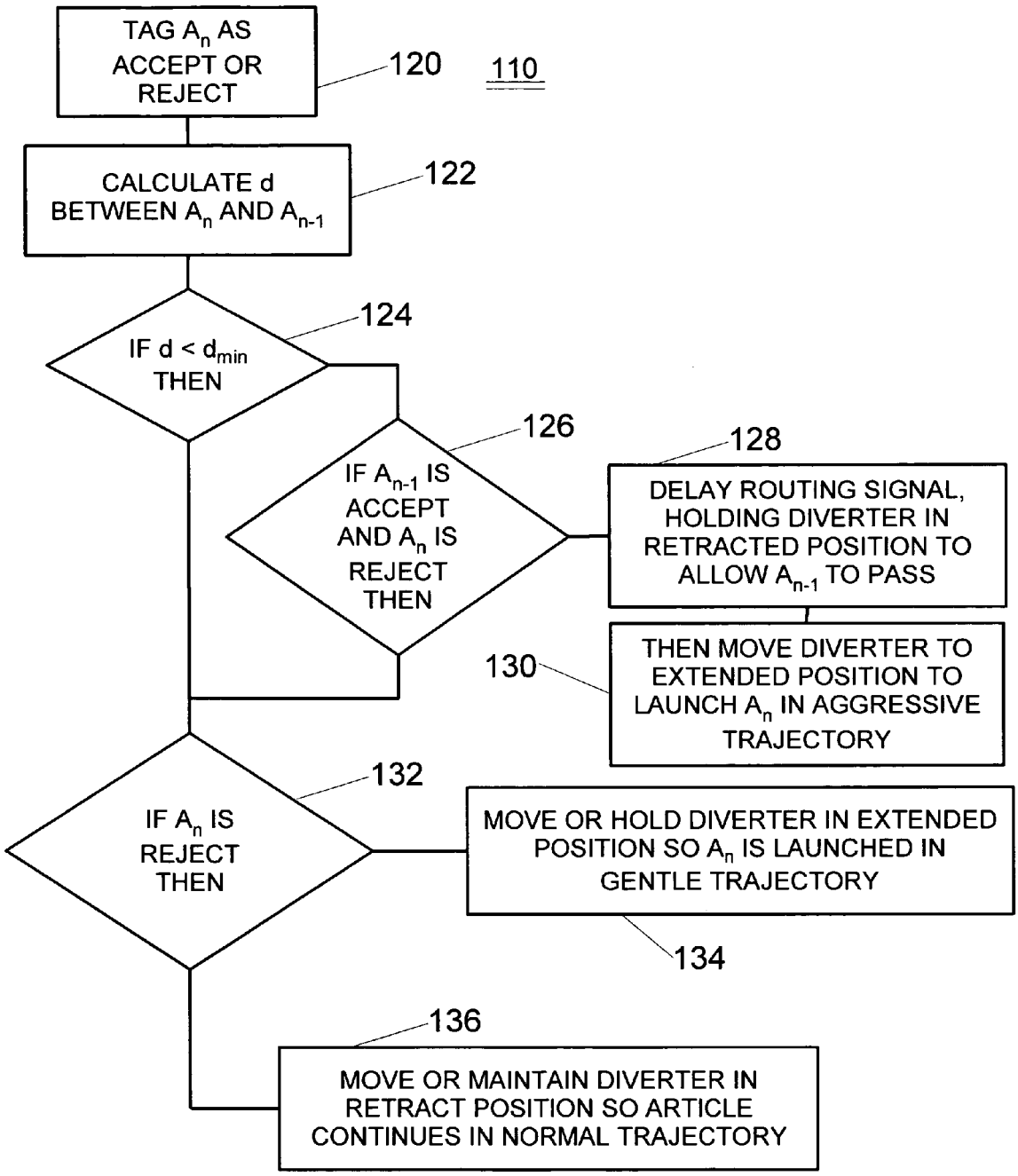
FIG. 7 is a flow chart of the diverter control routine in the sorting apparatus.

Now referring to FIGS. 2 and 7, the sorting processor 42 is configured to run a multiplicity of routines or operational tasks and processes as it fulfills its mission in the sorter 10. One such routine is a diverter control routine 110 and is composed of a number of steps to optimally control the diverter assembly 50 to accurately route articles according to directives from the sorting processor 42. A tag step 120 is followed by the sorting processor 42 where a current article, referred herein as $A_n$, is tagged as either ACCEPT or REJECT. The tag step 120 is followed by a calculation step 122 where a distance value is computed approximating the distance between a current article $A_n$ and an immediately preceding article located within a given or adjacent virtual lane 21 (FIG. 1). This distance value is referred herein as $A_{n-1}$.

The calculation step 122 is followed by a distance, threshold decision 124 where the distance is compared with a predefined minimum distance value referred herein as $d_{min}$. If the distance threshold decision 124 is true, then a type decision 126 is made based on review of the tag of each of $A_n$ and $A_{n-1}$. If the type decision 126 is true, then a delay step 128 is performed followed by an aggressive reject step 130.

If the distance threshold decision 124 or the type decision 126 is false, then a reject decision 132 is made. If the reject decision 132 is true, then a gentle reject step 134 is performed. If the reject decision 132 is false, then a pass step 136 is performed.

OPERATION

The operation of the present invention is believed to be readily apparent and is briefly summarized in the paragraphs which follow.

In operation, and referring to FIGS. 1-4, the incoming product stream 12 traveling the flow direction indicated by the arrow numerated as 14, is delivered to the sorter 10 in continuous fashion. Here, the product stream 12 is transported by the conveying means or endless belt conveyor 16 through the sorter 10 in a plurality of virtual lanes 21, and is transported and launched through the inspection station 20. The sorting processor 42 in the inspection station 20 receives and provides information from and to an operator through the user interface 18 which enables the accurate operation of the sorter 10 by facilitating the definition of sorting parameters which may include but are not limited to tables or regions of acceptable and unacceptable colors, foreign material colors or scatter, size thresholds for acceptable, unacceptable, and foreign material colors, and definitions of desirable and undesirable shape parameters.

Cameras 36, 38, and 40 provide a means to measure physical characteristics of objects in the product stream 12, and this measurement data is provided to the sorting processor 20 where it is compared with the sorting parameters discussed above to render a series of sorting decisions which are manifested as the plurality of routing signals 44.

Now referring to FIGS. 2, 5 and 7, and in a preferred embodiment, the product stream 12 is launched in an initial or normal trajectory generally pointed to by the numeral 100. Here a substantial portion of foreign material 34 in the product stream 12 is detected and tagged by the sorting processor 42, and is hence, diverted from the product stream 12 by the ejector 46 as it responds to the routing signals 44. This diversion is accomplished by jetting a pulse of air from the ejector 46 toward the foreign material 34 as it travels through the air adjacent to the ejector 46. The foreign material 34 responds by translating in a downward and diverging from the product stream 12 in a direction toward the ejector chute 48 where it is transferred for further processing or disposal.

Also, in a preferred embodiment, a substantial portion of acceptable articles 30 are detected and tagged by the sorting processor 42 by the diverter control routine 110 in the tag step 120 as ACCEPT and allowed to travel in the normal trajectory 100, uninfluenced by the ejector 46. Yet further, the sorting processor 42 in the pass step 136 provides routing signals 44 to the diverter assembly 50 to move or maintain it in a retracted position as shown in FIG. 5, allowing the acceptable articles 30 to pass without substantial interaction with the launching block 76 as they continue to travel in the normal trajectory 100. The acceptable articles 30 continue to travel, and are ultimately guided by the lower slide 52, where they are discharged for further processing.

Now referring to FIGS. 1, 2, 3, 6 and 7, and in a preferred embodiment, a substantial portion of unacceptable articles 32 are detected and tagged by the sorting processor 42 by the diverter control routine 110 in the tag step 120 as REJECT. Then, the sorting processor 42 measures or calculates the distance between a current article $A_n$ and a preceding article $A_{n-1}$ that is located in a current or adjacent virtual lane 21 associated with $A_n$ in the calculate step 122. Next, a distance threshold decision 124 is accomplished. If the distance threshold decision 124 is true, meaning that the distance is less than a minimum distance, then the type decision 126 is made based on the tag of $A_n$ and $A_{n-1}$.

Now, if $A_{n-1}$ is ACCEPT and $A_n$ is REJECT then the type decision 126 is true and the delay step 128 will be performed. Here, the routing signal 44 will be delayed, holding the diverter assembly 50 in the retracted position 102 to allow $A_{n-1}$ to pass. Then, after the delay step 128 is complete, the aggressive step 130 is performed, so the diverter assembly 50 is moved to launch $A_n$ in the aggressive trajectory 108 because the sorting processor 42 issues a routing signal 44 which causes the valve assembly 64 to port fluid to the actuator 66 to cause the rod 70 to control the position of the launching block 76. In this action, the unacceptable article 32 encounters the launching block 76 proximate to the contact surface 88 as it is moved from the retracted position 102 to the extended position 104, imparting an upward force on the article, and causing it to deviate from the normal trajectory 100, and follow a path approximately similar to the aggressive trajectory 108. The unacceptable article 32 may encounter the upper guide 56 and/or the upper slide 54 where it is discharged for further processing. This aspect of the operation of the sorter 10 enables efficient diversion of unacceptable articles 32 that are in the proximity of acceptable articles 30 in the same or adjacent virtual lanes 21, allowing the acceptable articles 30 to pass in the normal trajectory 100.

Alternatively, if the type decision 126 is false or if the distance threshold decision 124 is true, then the reject decision 132 is performed by the sorting processor 42. If the reject decision 132 is true, meaning that $A_n$ is tagged as REJECT, then the diverter assembly 50 is moved to the extended position 104 in a manner similar to that discussed above. If the diverter assembly 50 was already in the extended position 104, then it is maintained in that position. In either case, the unacceptable article 32 will encounter the launching block 76 when it is already at the extended position 104, so that it is encounters the contact surface 88. Here it will slide on the contact surface 88, traveling to the launching surface 90 which will redirect the motion, providing a smooth translation so that it is launched in the gentle trajectory 108, having minimal upward motion, and traveling until it encounters the upper slide where it is discharged for further processing.

In compliance with the statute, the invention has been described in language more or less specific as to structural and methodical features. It is to be understood, however, that the invention is not limited to the specific features shown and describe, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. A sorting apparatus for separating articles in a product stream, comprising:

an endless belt conveyor configured to transport articles in a product stream which includes acceptable articles, unacceptable articles, and foreign material, and then launch the product stream into a first trajectory;

an inspection station positioned along the first trajectory of the product stream, and which inspects the product stream to identify acceptable articles, unacceptable articles and foreign matter, and further generates a plurality of routing signals based upon the inspection of the product stream;

an air ejector assembly positioned adjacent to the product stream which is travelling in the first trajectory, and which selectively produces individual pulses of air in response to at least one of the routing signals, and which are directed toward the product stream, and wherein the pulses of air forcibly engage the product stream to dislodge foreign material from the product stream and direct the foreign material into a foreign matter trajectory; and a diverter located in spaced relation relative to the endless belt conveyor, and controlled by at least one of the routing signals, and wherein the inspection station is located therebetween the endless belt conveyor, and the diverter, and wherein the diverter has a launching block having a concave surface, and which is moveable between a retracted position, and an extended position, and wherein the diverter is located in spaced relation relative to the endless belt conveyor such that the launching block, when located in the extended position is located at a nominal angle of less than about 20 degrees from the first trajectory, and wherein acceptable articles identified in the inspection station extend their travel in the first trajectory when the launching block is located in the retracted position, and further, unacceptable products identified in the inspection station travel along the concave surface of the launching block when the launching block is in the extended position and are launched into a second trajectory.

2. A sorting apparatus as claimed in claim 1, and wherein the launching block further comprises:

a contact surface positioned along a portion of the concave surface;

a launching surface positioned along a portion of the concave surface; and an aperture formed in the launching block.

3. A sorting apparatus as claimed in claim 2, and wherein the diverter further comprises:

a mounting frame;

a pivot pin cooperating with the mounting frame, and launching block, and which is further matingly received through the aperture which is formed in the launching block; and an actuator positioned between the mounting frame, and the launching block, and which is operable to orient the diverter in the retracted position when the actuator is in a first position, and the extended position, when the actuator is in a second position.

4. A sorting apparatus as claimed in claim 3, and wherein the nominal angle of less than about 20 degrees is selected to reduce bruising of the articles as they contact the launching block.

5. A sorting apparatus as claimed in claim 4, and wherein the diverter is operable to launch unacceptable articles in a third trajectory by imparting an upwardly directed force to the unacceptable articles.

6. A sorting apparatus as claimed in claim 5, and wherein the air ejector assembly is operable to expel the foreign material from the product stream and move the foreign material into a fourth trajectory.

* * * * *